US005160505A

United States Patent [19]

Seveno et al.

[11] Patent Number: 5,160,505

[45] Date of Patent: Nov. 3, 1992

[54] METHOD AND APPARATUS FOR TRANSFER PRINTING OF SYNTHETIC FABRICS

[75] Inventors: Pierre L. P. M. Seveno, 61 Place Ladouceur, Repentigny, Quebec, Canada, J6A 6C7; Aime M. Lemire, St. Laurent, Canada

[73] Assignee: Pierre L. P. M. Seveno, Repentigny, Canada

[21] Appl. No.: 562,559

[22] Filed: Aug. 3, 1990

[30] Foreign Application Priority Data

Aug. 23, 1989 [CA] Canada ..... 609204

[51] Int. Cl.[5] ..... D06P 5/00

[52] U.S. Cl. ..... 8/471; 8/470; 101/34; 101/115; 101/47 D

[58] Field of Search ..... 2/471, 472; 8/471

[56] References Cited

U.S. PATENT DOCUMENTS

| | | | |
|---|---|---|---|
| 3,398,680 | 8/1968 | Moskowitz | 101/115 |
| 3,874,846 | 4/1975 | Ashe | 8/471 |
| 4,419,102 | 12/1983 | Gorondy | 8/471 |
| 4,420,307 | 12/1983 | Gorondy | 8/444 |
| 4,421,515 | 12/1983 | Gorondy | 8/444 |
| 4,421,517 | 12/1983 | Gorondy | 8/471 |
| 4,421,518 | 12/1983 | Gorondy | 8/471 |
| 4,427,412 | 1/1984 | Gorondy | 8/471 |
| 4,541,340 | 9/1985 | Peart et al. | 101/470 |
| 4,640,191 | 2/1987 | Bradley | 101/470 |

*Primary Examiner*—A. Lionel Clingman
*Attorney, Agent, or Firm*—Shlesinger, Arkwright & Garvey

[57] ABSTRACT

A method and apparatus for the transfer printing of a fabric web is provided. The apparatus includes a supply station for supplying a multi-layered web comprising a web of fabric to be printed and at least one substrate having a surface provided with a sublimation ink, the substrate being disposed in intimate frictional contact with the web of fabric so that the ink-carrying surface thereof is in contact with the web surface to be printed. The apparatus further includes a printing station for maintaining a slight pressure on the multi-layered web and for applying heat thereto to thereby effect the transfer of ink from the substrate to the web of fabric. A receiving station is also provided for separating the multi-layered web into a printed web of fabric and into at least one substrate, and further for collecting the printed web and substrate following the separation thereof. A drive source is provided for conveying the multi-layered web from the supply station, through the printing station and to the receiving station by applying tension to the substrate greater than that applied to the web of fabric. The apparatus finally includes controllers for maintaining the temperature of the printing station and for controlling the speed at which the multi-layered web is conveyed.

3 Claims, 6 Drawing Sheets

METHOD AND APPARATUS FOR TRANSFER PRINTING OF SYNTHETIC FABRICS

FIELD OF THE INVENTION

The present invention relates generally to the field of textile printing and specifically to transfer printing, also known as sublimation printing. More particularly, the present invention is directed to a method and an apparatus for the transfer printing of fabrics, wherein either or both sides of a fabric web may be printed and further characterized in that the fabric web is conveyed by at least one sublimation ink-carrying substrate disposed in frictional contact therewith.

The invention is especially well suited to the duplex or double-sided printing of single or multi-coloured designs on narrow width fabrics, up to approximately 6 inches wide, such as those employed in the fabrication of vertical window blinds.

BACKGROUND OF THE INVENTION

For many years, transfer printing processes have been employed in the textile industry for printing designs and colours onto the surface of fabrics, particularly synthetics such as double-knit polyester. Transfer printing techniques generally involve the transfer of a sublimation dye composition from an ink-carrying substrate, such as a web of paper, a metallic foil, or a plastic film, onto the fabric surface to be printed. The sublimation dyestuffs may be coated onto a heat resistant carrier such as a paper substrate by means of conventional printing techniques, for instance, gravure printing. Thereafter, the coated surface of the substrate is placed in intimate frictional contact with the fabric surface to be printed and both the fabric and substrate are subjected to heat and pressure, which results in the dye subliming from the surface of the substrate and depositing on the fabric to form a permanent design thereon. Typically, sublimation temperatures for known sublimation dye compositions are in the approximate range of a 125° to 235° C.

Prior to the advent of transfer printing in the textile industry, the duplex printing of fabrics was accomplished using conventional printing techniques. For instance, U.S. Pat. No. 3,398,680 issued to one Moskowitz on Aug. 27, 1968, discloses a duplex fabric printing machine which employs traditional rotary screen printing. Moskowitz teaches the use of opposing screen rollers containing printing fluids therein. The screen rollers according to Moskowitz are held in contact against the fabric web to be printed, each colour of a multicolour pattern or each design element thereof being applied serially. In contradistinction, transfer printing technology allows for more convenient and simplified operation, as multi-coloured printing inks or complex patterns may be disposed on the same substrate so that a single pass may suffice for achieving the desire printing effect on a fabric surface.

As for the more recent transfer printing techniques, the prior art machines and methods for effecting double-sided printing onto synthetic materials are generally inefficient in operation. For instance, U.S. Pat. No. 3,874,846 issued on Apr. 1, 1975 to one Ashe, discloses a method for transfer printing on opposite faces of a web of grey goods double-knit from a synthetic material. The transfer printing technique according to Ashe employs a pair of heated rotating cylinders which are disposed in tandem to thereby effect the printing of each fabric face sequentially. Moreover, each heated cylinder disclosed in the Ashe reference is provided with an endless belt for urging the fabric web and transfer paper thereagainst.

It is accordingly an object of the present invention to provide a method and an apparatus for transfer printing onto both sides of a web of fabric simultaneously, thereby overcoming the problems occasioned in the prior art devices and methods in which printing is performed sequentially on each face of the fabric. As such, it is an object of the present invention to eliminate design duplication and the additional capital and operating costs associated, for instance, with the provision of two serial heating stations as exemplified by known duplex transfer printing techniques.

It is another object of the present invention to provide a method and an apparatus for transfer printing wherein the fabric web to be printed is conveyed by the ink-carrying substrates which are disposed in intimate frictional contact therewith, to thereby eliminate the need for endless belts or other means in order to convey and support the fabric and printing substrates as found in the prior art.

It is yet another object of the instant invention to provide a method and an apparatus for simultaneous duplex transfer printing which result in lower costs of installation and operation, and provide for reliable and simplified printing of fabric webs of indefinite length, when compared to known techniques of transfer printing.

SUMMARY OF THE INVENTION

The present invention provides a novel method and an apparatus for transfer printing onto either or both sides of a fabric web, whereby the fabric web is conveyed by at least one sublimation ink-carrying substrate disposed in intimate frictional contact therewith and on the side thereof to be printed.

According to one broad aspect of the invention, there is provided a method for the transfer printing of a web of fabric or the like, said method comprising the steps of:

proving a multi-layered web of indefinite length from a supply station, said multi-layered web comprising a web of fabric to be printed and further comprising at least one substrate having a surface provided with a sublimation ink, said substrate being disposed in intimate frictional contact with said web of fabric so that said ink-carrying surface is in contact with the web surface to be printed;

conveying said multi-layered web from said supply station to a printing station by applying tension to said substrate greater than that applied to said web of fabric;

subjecting said multi-layered web in the said printing station to heat and slight pressure to thereby effect the transfer of ink from said substrate of the web of fabric;

separating said multi-layered web, following the printing thereof, into a printed web of fabric and into at least one said substrate; and collecting said printed web and said substrate following the separation thereof at a receiving station.

According to another broad aspect of the invention, there is provided an apparatus for the transfer printing of a web of fabric or the like, said apparatus comprising:

a supply station for supplying a multi-layered web, said multi-layered web comprising a web of fabric to be printed and further comprising at least one substrate having a surface provided with a sublimation ink, said substrate being disposed in intimate frictional contact with said web of fabric so that said ink-carrying surface is in contact with the web surface to be printed;

a printing station for receiving the multi-layered web from said supply station, for maintaining a slight pressure thereon, and for applying heat thereto to thereby effect the transfer of ink from said substrate to the web of fabric;

a receiving station for separating the multi-layered web, following the printing thereof, into a printed web of fabric and into at least one said substrate, and further for collecting said printed web and said substrate following the separation thereof;

drive source means for conveying said multi-layered web from said supply station, through said printing station and to said receiving station by applying tension to said substrate greater than that applied to said web of fabric; and control means for maintaining the temperature of said printing station and for controlling the speed at which said multi-layered web is conveyed.

BRIEF DESCRIPTION OF THE DRAWINGS

For the purposes of illustration, but not of limitation, embodiments of the invention are described hereinbelow with reference to the following drawings in which.

DETAILED DESCRIPTION OF THE PREFERRED EMBODIMENT

Figure 2:
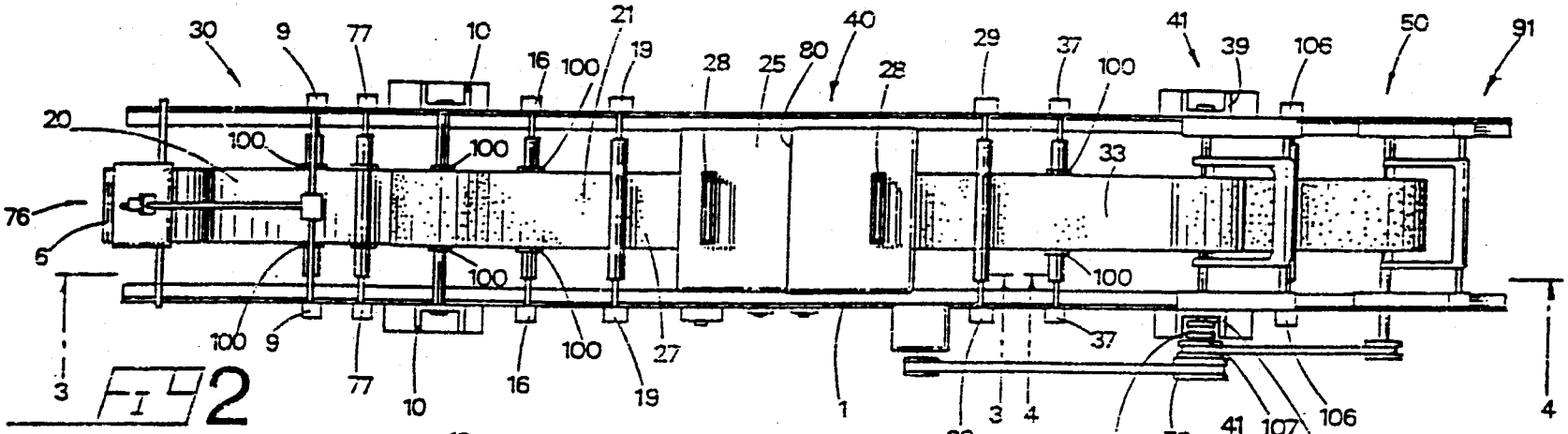
FIG. 2 is a top plan view of the apparatus depicted in FIG. 1.

Referring now to the drawings, there is depicted in FIGS. 1 to 9 an apparatus for carrying out the method of transfer printing according to the present invention. The apparatus comprises a supply station 30, a printing station 40 and a receiving station 50, each of these stations being disposed on a suitable support frame 1.

Supply station 30 includes a fabric supply roller 5 for the passive supply of an endless web of fabric 20 to be printed. Supply roller 5 is journalled onto support frame 1 or otherwise rotatably attached thereto. A guide tension device 76 having a freely pivoting arm 2 is pivotally attached to vertically extending members 9 of support frame 1 by means of a journalled shaft or the like, as at 3. The free end of guide tension device 76 is provided with a generally inverted U-shaped bracket 4 whose side flanges extend over the outside faces of the roll 6 of fabric 20 in order to ensure that the fabric web 20 is unwound from supply roller 5 in proper transverse alignment with idler guide rollers 7, 8 and 15. The latter idler guide rollers are respectively rotatably mounted onto vertical members 9, 77 and 16, and have flanges 100 adapted to maintain a desired transverse positioning of fabric web 20.

Guide tension device 76, by means if its freely pivoting nature, rests against roll 6 of fabric 20 so as to provide a slight tension to web 20 in conjunction with alignment idler guide rollers 7, 8 and 15. Upon unwinding from supply roller 5, web 20 is directed over idler guide roller 7, passing under idler guide roller 8 and then being directed over the idler guide roller 15. However, those skilled in this art will appreciate that other suitable passive supply means and guiding or tensioning means may be employed for the fabric web 20.

Supply station 30 further comprises an upper substrate supply roller 13 and corresponding lower substrate supply roller 14, which rollers are journalled onto vertical support posts 10 of support frame 1. Supply rollers 13, 14 respectively provided rolls 11, 12 of sublimation ink-carrying substrates 21, 22 wound thereon, which substrates are preferably heat resistant transfer papers well known to those skilled in this art. However, any other suitable ink-carrying substrates may be selected and adapted for use with the method and apparatus according to the present invention, as it will be apparent to the person skilled in this art.

Upper and lower substrate webs 21, 22 are passively fed from their respective supply rollers 13, 14, and are disposed on either side of fabric web 20 so that the ink-carrying surfaces thereof are adjacent the web 20. Upper substrate web 21, fabric web 20 and lower substrate web 22 are introduced between pinch rollers 17, 18, to thereby form a sandwich or multi-layered web 27 wherein the said substrate webs 21 and 22 are placed in intimate frictional contact with the opposite surfaces of fabric web 20. Pinch rollers 17, 18 are rotatably mounted onto vertical member 19 of support frame 1.

Figure 5:
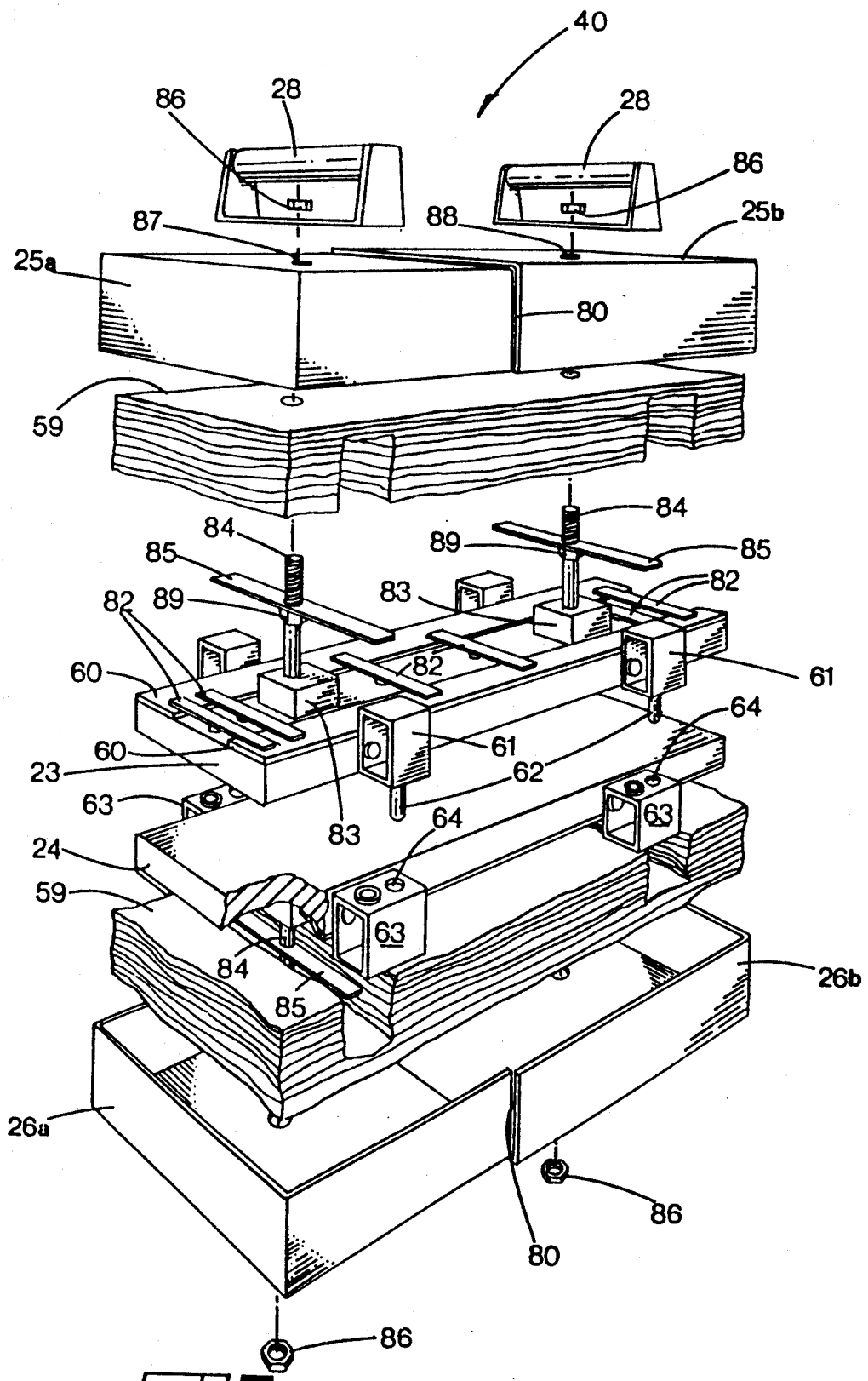
FIG. 5 is a partially exploded perspective view of the printing station of the apparatus depicted in FIGS. 1 to 3, showing the construction of two substantially parallel heat plates.

Following supply station 30, laminate web 27 is thereafter conveyed through printing station 40 shown in greater detail in FIG. 5. Printing station 40 comprises a pair of horizontally disposed parallel heat plates 23, 24, for heating each side of laminate web 27. The plates 23, 24 may be constructed from a suitable heat conducting material such as 6061-T6 aluminum alloy, and are smooth surfaced so that laminate web 27 may be conveyed therebetween in intimate surface contact therewith. For transfer printing onto narrow width fabric webs, it has been found that suitable plate dimensions are of the order of 48 inches long by 6 inches wide by 1 inch high. Those skilled in this art will appreciate that other materials or dimensions may be adapted for use with the heat plates of the preferred embodiment of the present invention.

The heat plates 23, 24 may be heated to sublimation temperatures by way of heating elements, for instance, flat electrical resistance elements 60, two of such elements 60 being longitudinally disposed in a parallel spaced apart relationship in contact with each one of the heat plates 23, 24. In order to circumvent the effects of differential thermal expansion between the elements 60 and the heat plates 23, 24, the elements may be secured thereagainst by means of a plurality of transverse flats 82 or the like, which are screw-mounted to the heat plates.

Heat plates 23, 24 are maintained in a spaced apart relationship so as to provide a slight and evenly distributed pressure onto multi-layered web 27. Whereas conventional transfer printing devices such as rotary cylinders are adapted to produce pressures on the fabric web of the order of up to approximately 4 psi, it has been found that transfer printing according to the method and apparatus of the present invention may be accomplished at much lower pressures.

The spacing between heat plates 23, 24 and hence the applied pressure therefrom, may be adjusted to suit different thicknesses of multi-layered web 27. One arrangement shown in FIGS. 5 to 7 comprises a set of four downwardly depending vertical pins 62 disposed on upper heat plate 23, to slidingly engage with floating cups 101 disposed on lower heat plate 24, the latter plate being fixedly attached to support frame 1. Pins 62 and corresponding cups 101 are respectively provided on upper and lower extension frames 61, 63, which extend laterally from the heat plates 23, 24 in a spaced apart relationship.

Figure 6:
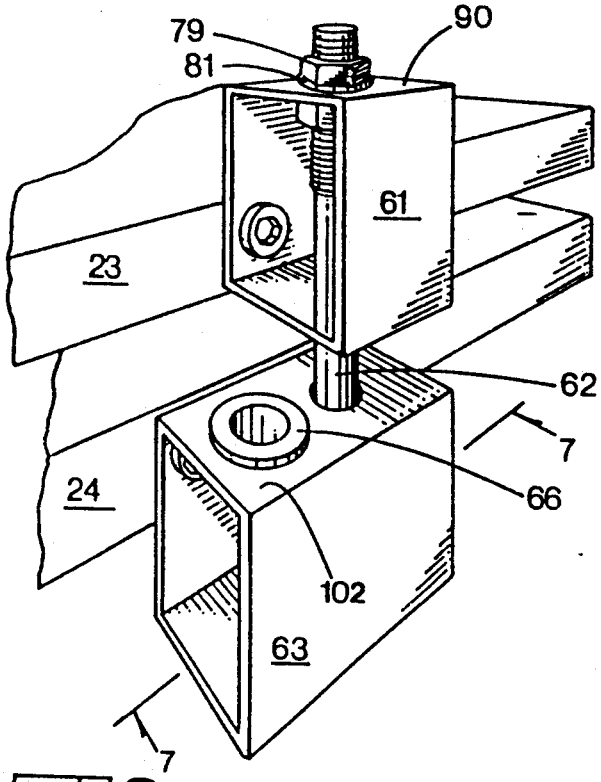
FIG. 6 is a perspective view, upon an enlarged scale compared to FIG. 4, showing the details of construction of one of four downwardly depending vertical pins disposed on the upper heat plate of FIG. 4, and one of four associated floating cups disposed on the lower heat plate of FIG. 4, said cups being adapted for sliding engagement with said pins.
Figure 7:
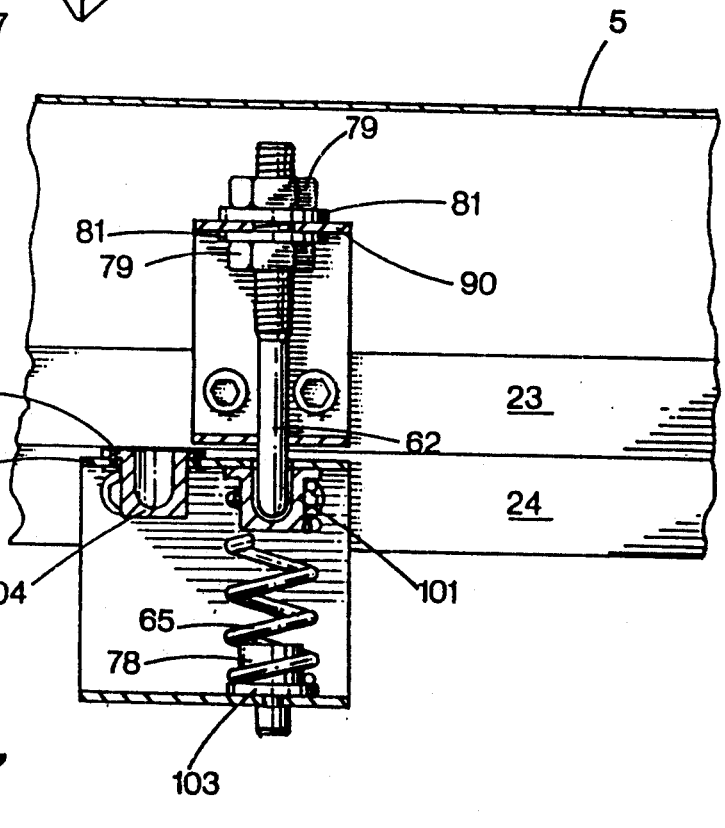
FIG. 7 is a cross-sectional view of the pin and cup arrangement of FIG. 6, taken upon the line 7—7 thereof.

As shown in FIGS. 6 and 7, upper extension frames 61 support a pin member 62 by means of a pair of opposed nuts 79 and washers 81 on opposite sides of the top portion 90 of frame 61. The arrangement permits the lengths of pins 62 to be individually adjusted. Lower extension frames 63 provide two positions for slidingly receiving the pins 62. The first position is defined by a fixed cup 104, having a raised outer flange 66 resting on the top portion 102 of frame 63. In this first position, the fixed cups 104 are adpated to maintain upper and lower heat plates 23, 24 in a widely spaced apart relationship when printing station 40 is not in operation. The second position of the heat plates is provided by apertures 64, through which pins 61 are introduced in order to engage with floating cups 101. This second position defines the spaced apart relationship of heat plates 23, 24 during the operation of printing station 40. Biasing means, such as coil springs 65, may be housed within lower extension frames 63 to resiliently support floating cups 101. Coil springs 65 are in turn mounted onto flanges 103 of cylindrical bases 78, the latter being adjustable as to height so as to increase or decrease the tension of spring 65 as desired. In the foregoing manner, cylindrical bases 78, in conjunction with the adjustable extension of pins 62 described above, allow for the appropriate vertical separation between the plates to be selected.

In order to select either of the two positions for the heat plates described above, upper heat plate 23 may be lifted away from lower heat plate 24 by means of handles 28 and repositioned so that pins 62 are introduced into the fixed cups 104 or floating cups 101, as the case may be. The connection of handles 28 to heat plate 23 is described in greater detail hereinbelow.

For a given width of laminate web 27, the spacing of heat plates 23, 24 is set wide enough to enable the transfer paper webs to be pulled therethrough without tearing, but narrow enough to obtain a uniform and adequate heat transfer from heat plates 23, 24 to the multi-layered web 27 and further, to obtain good frictional contact between the fabric web and each transfer paper so as to prevent slippage of the papers vis-e,gra/a/ -vis the web, thereby achieving a uniform printing definition on the fabric web 20. Typically then, such spacing will vary in accordance with the thickness of the particular fabric web desired to be printed.

Figure 9:
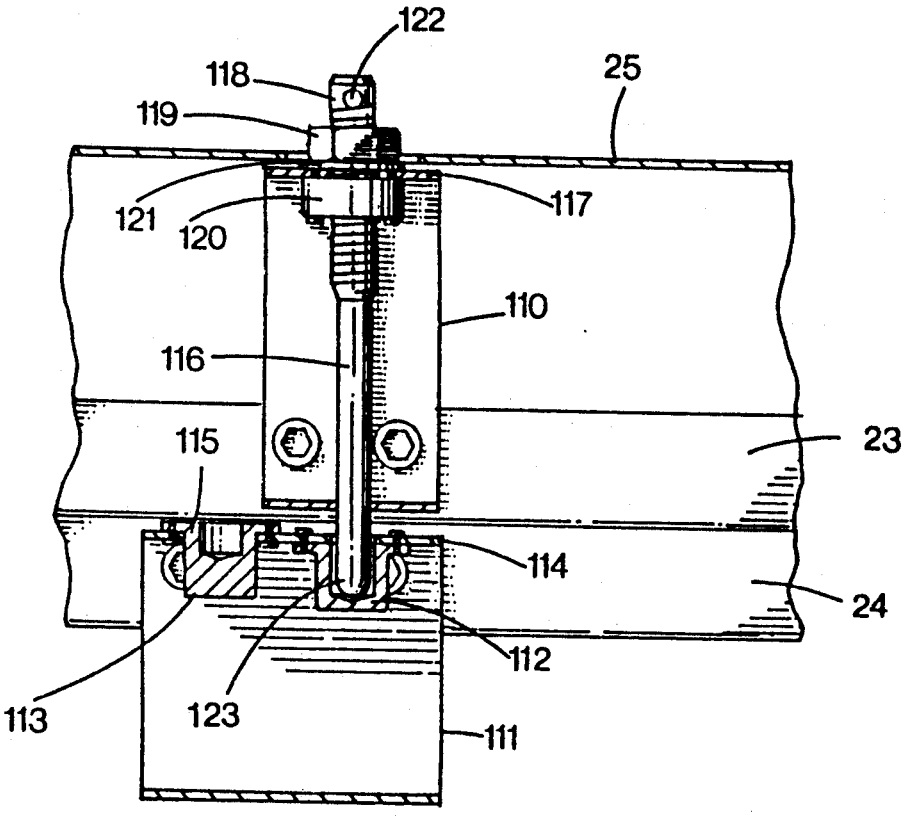
FIG. 9 is a cross-sectional view of an alternative pin and cup arrangement to that depicted in FIGS. 6 and 7.

Alternate means of maintaining a desired spacing between the heat plates 23, 24 will be apparent to those skilled in this art. For instance, another suitable arrangement for spacing apart the heat plates 23, 24 is shown in FIG. 9. This alternate arrangement comprises yet another set of four downwardly depending vertical pins 116 disposed adjacent upper heat plate 23. However, in this particular arrangement, the associated cups 112 defining the operative position for the plates are disposed on lower heat plate 24 by being fixed onto corresponding lower extension frames 111 rather than floating therein as previously described. Extension frames 111 are in turn fixedly attached to lower plate 24.

Upper extension frames 110 of heat plate 23 support the pins 116 as described hereinbelow. The latter frames are fixedly attached to upper heat plate 23 and each provides a tapped collar 120 which is fixedly attached to the respective undersurfaces of top portions 117 of frames 110. Top portions 117 of the extension frames 110 are adjacent the inner top surface of top cover 25, as shown. Pins 116 each consist of a lower blunted end 123 adapted to engage with fixed cup 112, and an upper threaded end 118, the latter being adapted for screw-fit engagement with tapped collar 120. Upper end 123 of pin 116 extends upwardly from collar 120, through top portion 117 and then out through the upper surface of top cover 25. Washers 121 and fixing nuts 119 are each respectively provided on the upper threaded ends 118 of pins 116, washers 121 being disposed between nuts 119 and the top surfaces of top portions 117.

The vertical gap between heat plates 23 and 24 may be adjusted by individually varying the respective effective lengths of pins 116 as follows. The exposed upper ends 118 of pins 116 may be rotated so as to extend or retract the blunted ends 123 thereof relative to extension frames 110, for instance, with the aid of a pin or key introduced into transverse aperture 122. The selected position of a pin 123 may be thereafter maintained by tightening the fixing nut 119 against washer 121 and the top surface of top portions 117 of frames 110.

As with the cup and pin configuration shown in FIGS. 5 to 7, lower extension frames 111 provide a second fixed set of cups 113 for defining the raised position for the heat plates as aforesaid.

The temperatures of the heat plates 23, 24 should be maintained at or above the particular sublimation temperature of the ink-carrying substrate used and well below the melting point of the synthetic fabric to be printed. Such temperatures will generally be in the approximate range of 125° to 235° C. The resistance elements 60 described hereinabove may be adapted so as to generate approximately 9 to 11 Watts/sq.in. over the heat plate surfaces in order to achieve the desired temperatures for sublimation. Temperature control means for the heat plates are well known to those skilled in this art and preferably consists of a time proportional on-off controller. It has been found that a single thermocouple (not shown) may be centrally disposed on each of the heat plates 23, 24 to provide the required measurement of temperature for control purposes. A control panel 105 may be disposed on support frame 1, providing control selectors 60, 61 for setting independently the respective temperatures of the upper and lower heat plates 23, 24.

For greater safety and operating convenience, the heat plates 23, 24 are preferably housed in insulating covers 25, 26, which have a generally hollow configuration and are filled with a suitable insulator material 59, for instance, glass wool or the like. In order to allow for high temperature expansion, each of covers 25, 26 may be halved transversally as at 80 (FIGS. 1, 2 and 5) and adapted for slip-fit longitudinal interconnection. Each half 25*a*, 25*b* (FIG. 5) of top cover 25 may be mounted over upper heat plate 23 by means of vertically extending bolts 84, whose lower terminal ends are fixedly attached to extension blocks 83 disposed on the upper surface of the heat plate. The bolts are provided with transverse support members 85 which rest on nuts 89 located on the bolts 84. The ends of bolts 84 protrude through insulator material 59 and out through apertures 87 located on the upper horizontal surfaces of cover halves 25*a*, 25*b*. A similar configuration may be employed for affixing bottom cover halves 26*a*, 26*b* to lower heat plate 24. As mentioned hereinabove, top cover 25 may be provided with handles 28 or other gripping means, fixedly attached thereto by nuts 86 disposed on bolts 84.

The heat and slight pressure provided at printing station 40 result in the transfer of ink from each of the ink-carrying transfer papers 21, 22 to opposite sides of the fabric web 27 simultaneously. The appropriate dwell time of laminate web 27 in contact with heat plates 23, 24 will be dependent on the selected ink-carrying substrate and the chosen temperature for the plates; the higher the operating temperature, the shorter the dwell time required for sublimation. Additionally, the speed at which web 27 is conveyed through printing station 40 may also be utilized in order to vary the web dwell time required in contact with the plates at a given temperature. It has been found that using heat plates which are 48 inches in length will permit web conveyance speeds in the approximate range of 5 to 10 meters per minute.

Following printing, multi-layered web 27 is conveyed to receiving station 50. The web is translated through pinch rollers 31, 32, which are journalled or otherwise rotatably attached onto vertical members 29 of support frame 1. Thereafter, the laminate web 27 is separated into its three component layers: a printed web 34 and upper and lower spent transfer papers 33, 35. Upper spent transfer paper 33 is directed over idler guide roller 36 and is then collected at upper paper batcher 41 which batcher is disposed on vertical support posts 39. Idler guide roller 36 is rotatably mounted onto vertical members 37 of support frame 1 and is provided with flanges 100 for proper transverse alignment of spent transfer paper 33. Transfer paper 33 is further conveyed around drive roller 43 and wound onto take-up spool 45 which forms a nip therewith. Take-up spool 45 is rotatably attached to a freely pivoting bracket 47, pivotally attached as at 49 to horizontal members 51 of post members 39. The described arrangement of paper batcher 41 permits a constant speed of conveyance of transfer paper 33 notwithstanding the increase in diameter of take-up spool 45 as transfer paper 33 is progressively wound thereon, because the drive roller speed is held constant. A similar arrangement is used for collecting lower spent transfer paper 35, whereby lower paper batcher 42 is also disposed on vertical post members 39. Lower batcher 41 comprises a drive roller 44 and associated take-up spool 46. As with upper batcher 41, take-up spool 46 is rotatably attached to pivoting bracket 48, journalled as at 50 onto horizontal member 52 of support posts 39.

Printed fabric web 34 is directed under idler guide rollers 38 and 53, each of which is respectively journalled or otherwise rotatably mounted onto vertical members 37, 106 of support frame 1. Flanges 100, disposed on idler guide rollers 38, 53, ensure proper transverse alignment of the printed fabric web 34. From roller 53, printed fabric web 34 is collectdd at fabric batcher 91. Fabric web 34 is directed over take-up spool 54, the latter being driven by a drive roller 55. As is the case with spent transfer paper batchers 41, 42, take-up spool 54 is rotatably mounted onto pivoting bracket 56, which in turn is journalled as at 57 onto a batcher frame 58 fixedly disposed on support frame 1. Alternate means of receiving and collecting the fabric web and transfer papers may be adapted for use with the present invention, for instance, a spool and clutch arrangement well known in this art may be employed in lieu of the batcher described above.

It is to be understood that the conveyance of fabric web 20 through printing station 40 is largely achieved by the frictional contact of transfer papers 21, 22 therewith. On account of the inherent plasticity of synthetic fibers at the elevated temperatures required for effective transfer printing, the take-up of printed fabric web 34 by fabric batcher 91 should be performed with a minimal tension on the fabric web and this, in order to avoid the plastic stretching or necking of the web. As will be described in greater detail hereinbelow, the tension of printed web 34 may be controlled by suitably adjusting the speed of fabric dirve roller 55 relative to that of paper drive rollers 43, 44.

Figure 1:
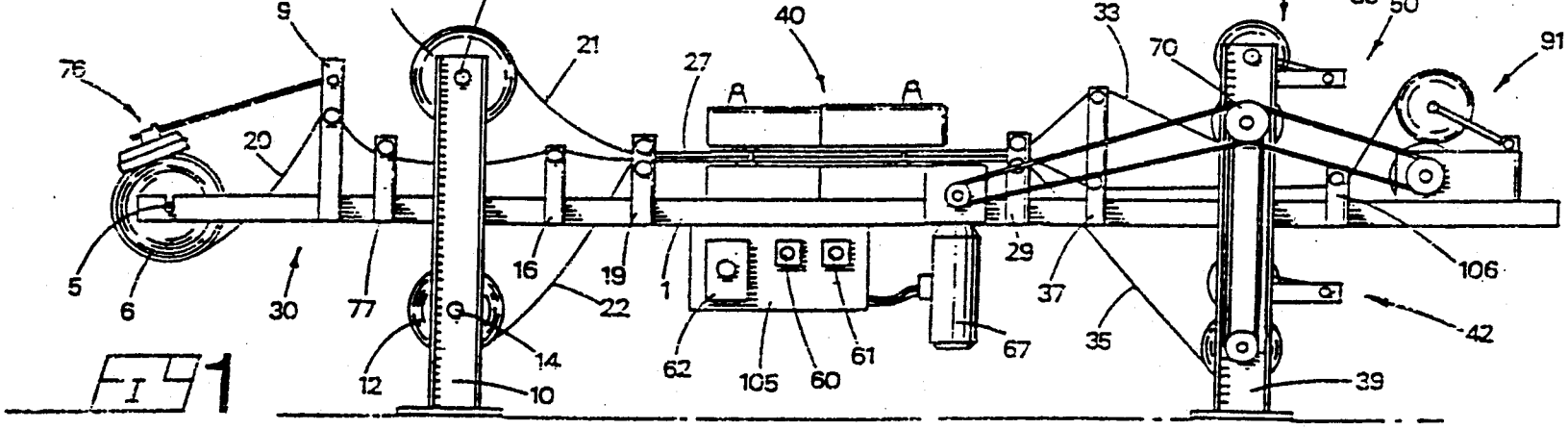
FIG. 1 is a front elevational view of an apparatus according to the present invention for the simultaneous duplex transfer printing of a fabric web of indefinite length, comprising a supply station, a printing station and a receiving station.
Figure 3:
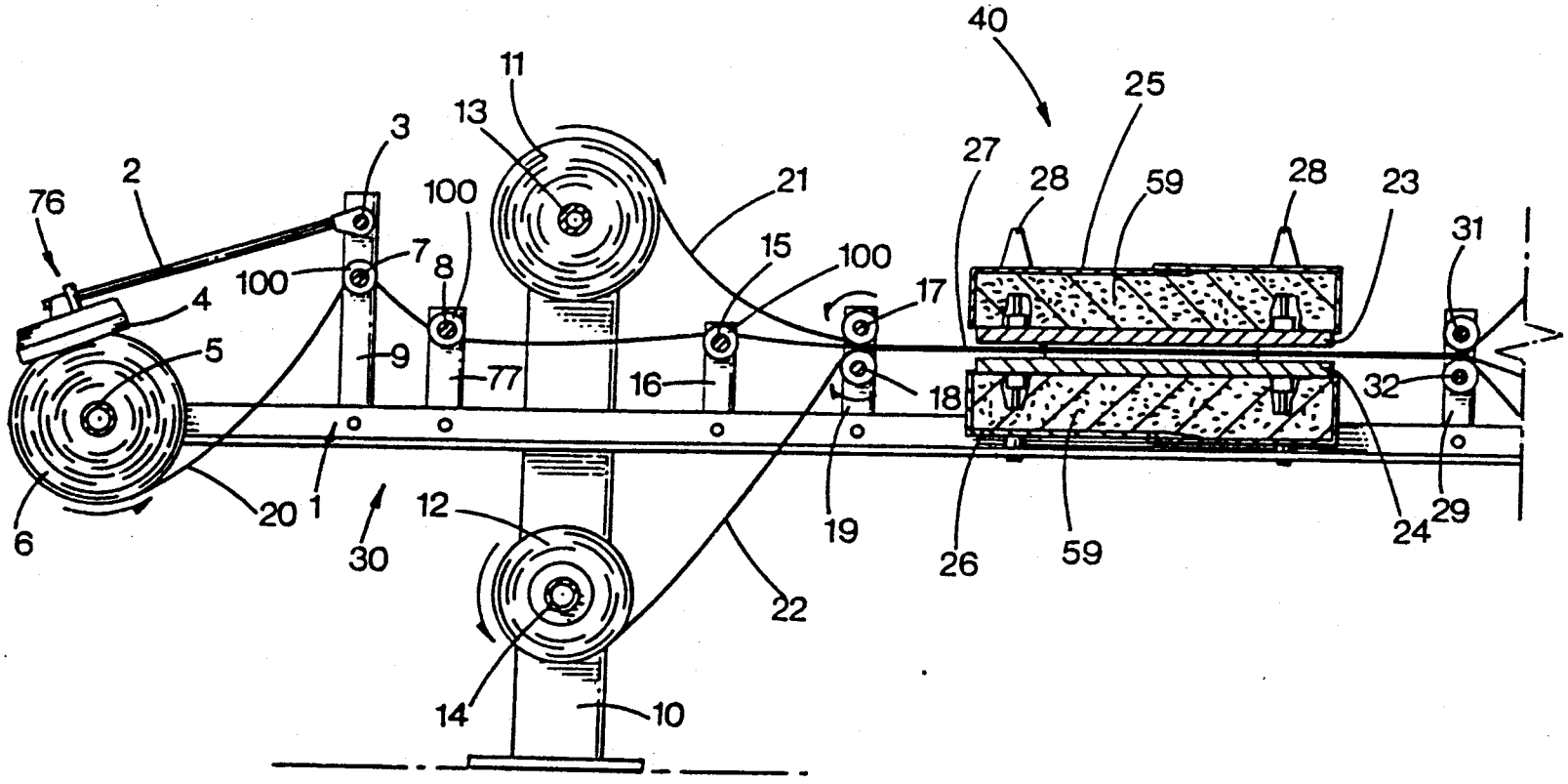
FIG. 3 is a partial cross-sectional view of the apparatus depicted in FIGS. 1 and 2, taken upon the line 3—3 of FIG. 2 and illustrating the supply station and printing station of the said apparatus.
Figure 8:
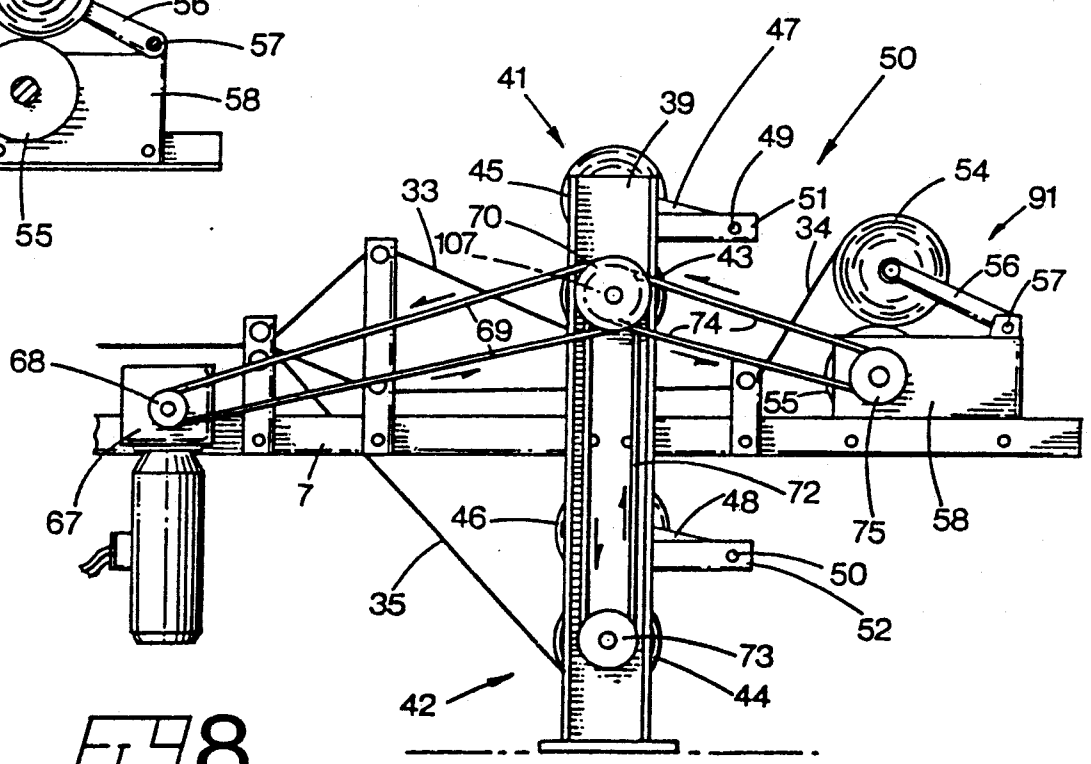
FIG. 8 is a partial elevational view of the receiving station of the apparatus depicted in FIGS. 1 to 3, illustrating the details of the drive source means therefor.
Figure 4:
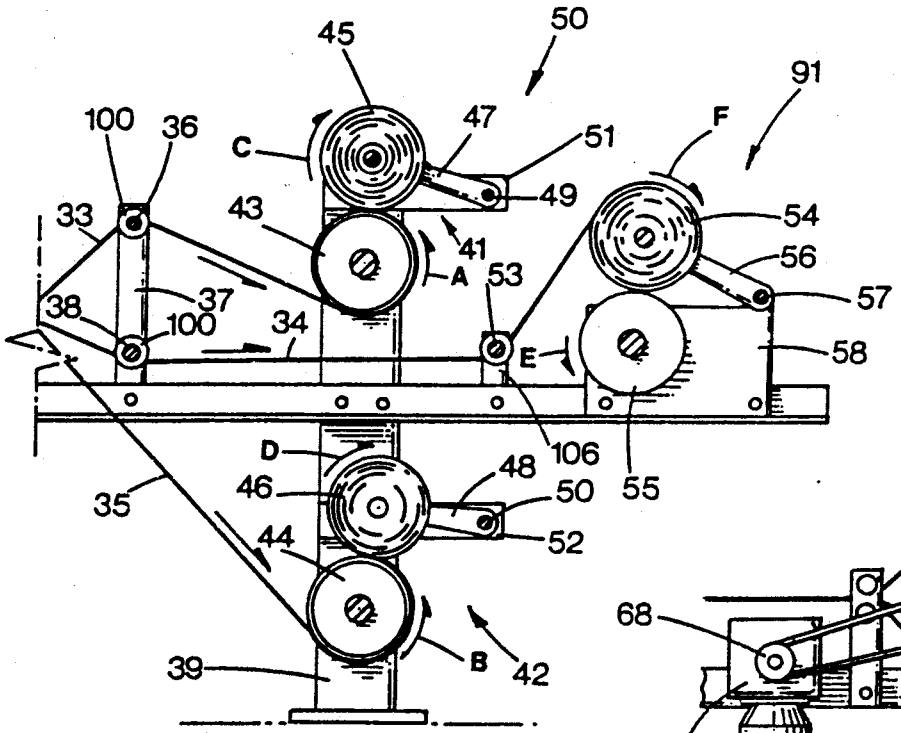
FIG. 4, shown on the same sheet of drawings as FIG. 8 is another partial sectional view of the apparatus depicted in FIGS. 1 and 2, taken upon the line 4—4 of FIG. 2 and illustraing the receiving station of the said apparatus.

Referring now to FIG. 8, the drive source means for the apparatus according to the present invention comprises a variable speed drive 67, such as a variable DC motor or the like. The speed of drive may be conveniently selected by means of a control 62 mounted onto panel 105 (FIG. 1). Variable drive 67 powers a horizontally disposed shaft 68 which, by means of belt 69 or the like, transmits rotative drive to pulley 70 of upper paper drive roller 43. A second pulley 71 (FIG. 2) is operatively connected to drive roller 43 and transmits rotative drive to pulley 73 of lower paper drive 44 by means of a belt 72 or the like. Each of drive rollers 43, 44 are driven at the same speed of rotation. A third pulley 107, preferably a V-pulley, is also operatively connected to drive roller 43 and transmits rotative drive by means of a V-belt 74 to V-pulley 75 of fabric drive roller 55. The lateral spacing of the opposed faces of V-pulley 75 may be adjusted so as to increase or decrease the effective diameter of the pulley and hence the relative speed of printed fabric web 34 compared to that of spent transfer papers 33, 35. In this manner, the tension on printed fabric web 34 may be adjusted in order to permit the transfer papers to convey the fabric through the printing station as aforesaid. Other suitable drive means will be apparent to those skilled in this art.

Although the disclosed invention is well suited to transfer printing on narrow width fabric webs of up to 6 inches in width, the present method and apparatus may be adapted to print onto much wider fabric webs by increasing the width of upper and lower heat plates 23, 24. Moreover, the apparatus disclosed herein may be readily adapted to process a number of fabric webs in parallel, thereby increasing the operating capacity thereof. The apparatus disclosed hereinabove may also be suitably employed in order to effect single-sided transfer printing of a fabric web of indefinite length by heating only one of the two heat plates 23, 24 and by substituting a backing paper or the like instead of an ink-carrying transfer paper adjacent the fabric web face which does not require printing. For single-sided printing of highly heat resistant fabrics or of heavy fabric grades, such backing paper may not be required, as these fabrics may be subjected to considerable tension without plastic deformation.

Other modifications of detail coming within the scope of the present invention include adapting the disclosed apparatus for the single-sided transfer printing of composite fabric webs consisting of a heat sensitive layer such as a polypropylene backing film having synthetic fibers woven thereon. The transfer printing of such synthetic fibers may be achieved by subjecting the fibers and a suitable transfer paper in contact therewith to one of the heat plates 23, 24 while the heat sensitive backing is simultaneously in contact with the other plate, which other plate is provided with water cooling or other means of protecting the backing from the heat generated in transfer printing the woven synthetic fibers.

It will, of course, be understood that the present invention has been described above purely by way of example, and those skilled in this art will appreciate that various other modifications of detail can be made coming within the scope of the invention as defined in the appended claims.

What we claim as our invention is:

1. A continuous method for the transfer printing of a web of synthetic fabric, said method comprising the steps of:

a) providing a multi-layered web of indefinite length from a supply station, said multi-layered web including a web of synthetic fabric to be printed and further including a first transfer print carrier web and a second transfer print carrier web, the first and second carrier webs each having a surface which carries a sublimable dye, said first and second carrier webs being disposed in intimate frictional contract with opposite surfaces of said web of fabric so that said surfaces carrying said sublimable dye are repectively in contact with the surfaces of the web of fabric to be printed;

b) conveying said multi-layered web from said supply station to a printing station by applying tension to said first and second carrier webs greater than that applied to said web of fabric;

c) subjecting said multi-layered web in said printing staton to heat and slight pressure by conveying said multi-layered web between two opposed stationary heated surfaces of said printing station, such that each stationary heated surface is respectively disposed on opposite sides of the multi-layered web, said first and second carrier webs each respectively being in contact against said two opposed stationary heated surfaces while said web is being conveyed therebetween to thereby effect the sublimation of the sublimable dye from each of said carrier webs and the transfer of said dye onto both surfaces of the web of fabric simultaneously, said contact being for a time sufficient to cause said sublimation and transfer;

d) separating said web of fabric from said first and second carrier webs; and e) collecting said web of fabric and said carrier webs following the separation thereof at a receiving station.

2. The method according to claim 1, wherein each of said carrier webs is a transfer paper.

3. The method according to claim 2, wherein said temperature of the printing station is maintained at a temperature within the range of about 125° to 235° C.

* * * * *

UNITED STATES PATENT AND TRADEMARK OFFICE

CERTIFICATE OF CORRECTION

PATENT NO. : 5,160,505

DATED : November 3, 1992

INVENTOR(S) : Pierre L. P. M. Seveno and Aime M. Lemire

It is certified that error appears in the above-identified patent and that said Letters Patent is hereby corrected as shown below:

In Column 2, at line 44, please change "proving" to --providing--.

In Column 10, at line 9, please change "contract" to --contact--.

In Column 10, at line 18, please change "staton" to --station--.

Signed and Sealed this

Nineteenth Day of October, 1993

*Attest:*

Bruce Lehman

BRUCE LEHMAN

*Attesting Officer*

*Commissioner of Patents and Trademarks*